US009685731B2

(12) United States Patent
Chonan

(10) Patent No.: US 9,685,731 B2
(45) Date of Patent: Jun. 20, 2017

(54) WATERTIGHT CONNECTOR

(71) Applicant: Sumitomo Wiring Systems, Ltd., Yokkaichi, Mie (JP)

(72) Inventor: Takahisa Chonan, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/276,848

(22) Filed: Sep. 27, 2016

(65) Prior Publication Data

US 2017/0104292 A1 Apr. 13, 2017

(30) Foreign Application Priority Data

Oct. 8, 2015 (JP) ..... 2015-199989

(51) Int. Cl.
*H01R 13/52* (2006.01)

(52) U.S. Cl.
CPC ..... *H01R 13/5221* (2013.01); *H01R 13/5202* (2013.01); *H01R 13/5205* (2013.01)

(58) Field of Classification Search
CPC ..... H01R 13/5205
See application file for complete search history.

(56) References Cited

U.S. PATENT DOCUMENTS 4,560,219 A * 12/1985 Chapelot ..... H01R 13/5221 439/272
5,679,019 A * 10/1997 Sakai ..... H01R 13/5208 439/271
5,906,499 A * 5/1999 Sikora ..... H01R 13/5221 439/271
6,193,549 B1 * 2/2001 Suzuki ..... H01R 13/4223 439/511
2006/0094275 A1 5/2006 Fukatsu et al.

FOREIGN PATENT DOCUMENTS

JP 2006-127992 5/2006

* cited by examiner

*Primary Examiner* — James Harvey
(74) *Attorney, Agent, or Firm* — Gerald E. Hespos; Michael J. Porco; Matthew T. Hespos

(57) ABSTRACT

A watertight connector has a one-piece rubber plug (50) on a rear part of a housing (70), and a rear holder (30) to be locked to the housing (70) is behind the rubber plug (50). A receptacle 10 is fit externally to the housing (70) from the front and closely contacts lips (55) of the rubber plug (50). The receptacle (10) includes short side walls (15) facing each other in a first direction and long side walls (14) facing each other in a second direction. The rear holder (30) includes short surfaces (38) at inner sides of the short side walls (15) and long surfaces (37) at inner sides of the long side walls (14). Holder-side escaping portions (43) retracted more backward than front ends of the long surfaces (37) are provided on front ends of the short surfaces (38) of the rear holder (30).

3 Claims, 8 Drawing Sheets

WATERTIGHT CONNECTOR

BACKGROUND

1. Field of the Invention

The invention relates to a watertight connector.

2. Related Art

Japanese Unexamined Patent Publication No. 2006-127992 discloses a watertight connector with a housing for accommodating terminal fittings, a one-piece rubber plug arranged on a rear end part of the housing and seal holes through which wires connected to the terminal fittings are to be inserted in a liquid-tight manner. A rubber plug holder is arranged behind the one-piece rubber plug for sandwiching the one-piece rubber plug between the housing and the rubber plug holder by being locked to the housing, and a receptacle-like cap is fit externally to the housing from the front. A busbar body is mounted into a front end part of the housing and is formed by integrating a busbar with a holding body. The terminal fittings are connected to the busbar and short-circuited in a predetermined pattern when the busbar body is mounted into the housing. The cap is fit to the housing after the busbar body is mounted and an opening end part of the cap is held in close contact with a lip formed on the outer periphery of the one-piece rubber plug to prevent intrusion of water into the cap through a clearance between the inner periphery of the cap and the outer periphery of the one-piece rubber plug. The cap has a wide flat opening shape defined by arcuate short side walls that face each other in a lateral direction and straight long side walls facing each other in the vertical direction.

In the process of mounting the cap on the housing, the opening end part of the cap moves onto lips of the one-piece rubber plug and slides. Thus, the lips may be dragged by the cap to tilt. If the last lip largely tilts, this lip may be caught between the rubber plug holder and the cap and it may not be possible to ensure sealing. More particularly, if wires having a large outer diameter are inserted into the seal holes and the one-piece rubber plug bulges out, a large resilient reaction force is applied to the opening end part of the cap from the lip side of the one-piece rubber plug. Although the long side walls can suppress a contact pressure with the lip side by being deflected and deformed, the short side walls are difficult to deflect and deform and, hence, it is difficult to make a contact pressure with the lip side smaller. Thus, the lips tilt more on the short side walls than on the long side walls and the one-piece rubber plug is caught easily.

The invention was completed based on the above situation and aims to provide a watertight connector capable of ensuring sealability by avoiding the catching of a one-piece rubber plug.

SUMMARY

The invention is directed to a watertight connector with a housing into which terminal fittings are to be inserted. A one-piece rubber plug is arranged on a rear end part of the housing. The rubber plug includes seal holes through which wires connected to the terminal fittings are to be inserted in a liquid-tight manner and a lip on an outer periphery. A rear holder is arranged behind the one-piece rubber plug and is configured to sandwich the one-piece rubber plug between the housing and the rear holder by being locked to the housing. The watertight connector further has a receptacle to be fit externally to the housing from the front. The receptacle has an opening end part to be held in close contact with the lip of the one-piece rubber plug. The receptacle includes short side walls facing each other and extending in a first direction and long side walls facing each other and extending in a second direction intersecting the first direction. The rear holder includes short surfaces arranged at inner sides of opening end parts of the short side walls and long surfaces arranged at inner sides of opening end parts of the long side walls. Additionally, holder-side escaping portions are provided on front ends of the short surfaces of the rear holder and are retracted more backward than front ends of the long surfaces.

When the lip of the one-piece rubber plug contacts the opening end part of the receptacle, the long side walls of the receptacle are deflected and deformed to reduce a contact pressure with the lip. Thus, the tilt of the lip can be suppressed to be small and predetermined sealing can be ensured. On the other hand, the short side walls of the receptacle are difficult to deflect and deform, and the lip on the short side walls may be dragged by the receptacle to tilt back. However, the lip can tilt toward the holder-side escaping portions of the rear holder and will not be caught between the rear holder and the receptacle.

The receptacle-side escaping portions may be tapered and inclined back. According to this configuration, the lip can be inclined along the holder-side escaping portions and the damage of the lip can be prevented more reliably.

The rear holder may include lock pieces projecting forward through through holes of the one-piece rubber plug and having tips to be locked to the housing. The lock pieces are arranged at positions closer to the short surfaces than to the long surfaces. The lock pieces penetrate through the through holes of the one-piece rubber plug so that the one-piece rubber plug bulges out to increase a contact pressure between the receptacle and the lip. Thus, the lip on the short side walls easily tilts. Therefore, a merit of providing the holder-side escaping portions at positions corresponding to the short side walls and allowing the lip to escape toward the holder-side escaping portions increases.

DETAILED DESCRIPTION

Figure 1:
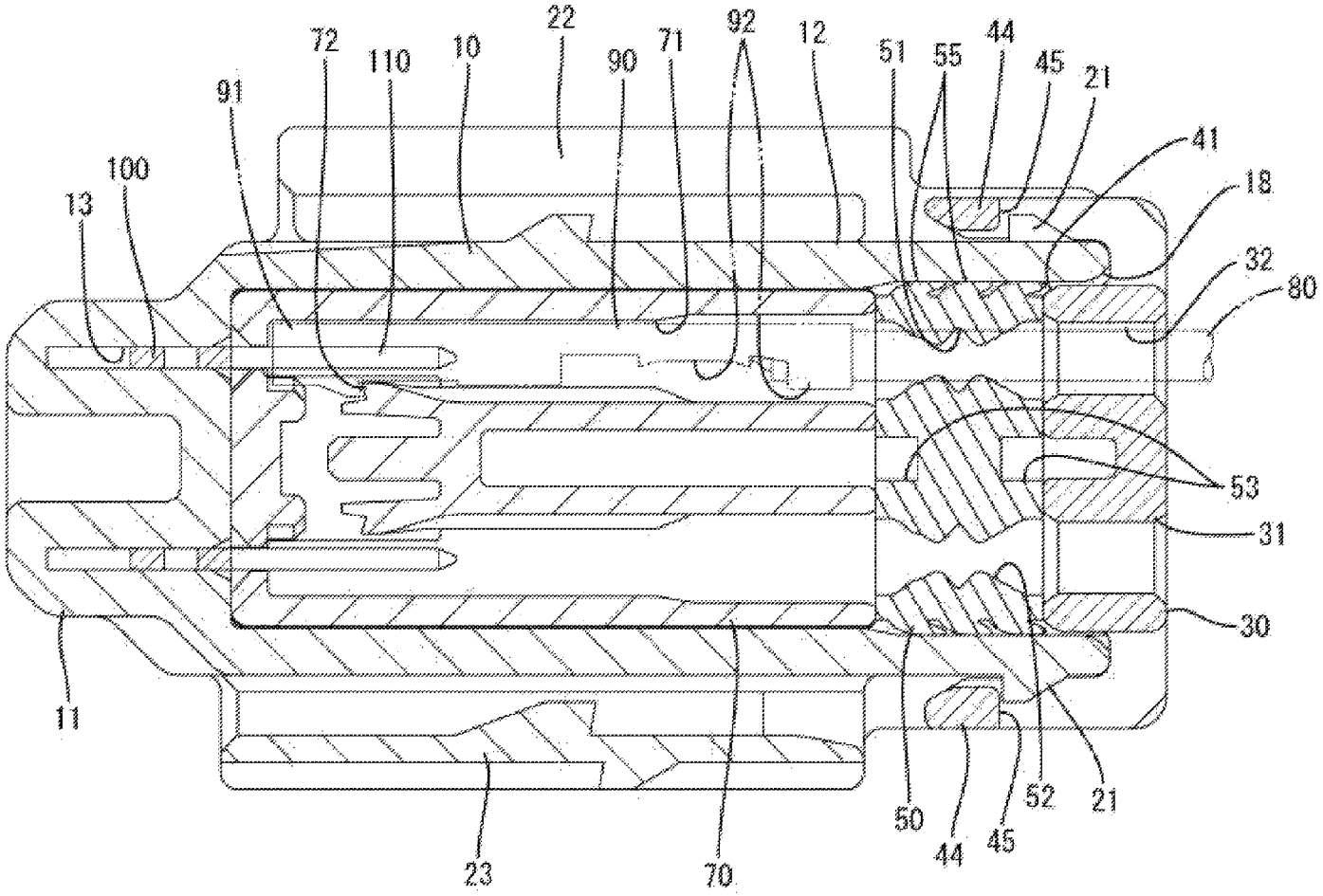
FIG. 1 is a section of a watertight connector according to an embodiment of the invention.

A watertight connector according to an embodiment of the invention is illustrated, as shown in FIGS. 1 to 8. As shown in FIG. 1, the watertight connector includes terminal fittings 90 made of electrically conductive metal, a housing 70 made of synthetic resin and capable of accommodating each terminal fitting 90, a one-piece rubber plug 50 made of rubber and arranged on a rear end part of the housing 70, a rear holder 30 made of synthetic resin and arranged behind the one-piece rubber plug 50 to be locked to the housing 70, busbars 100 made of electrically conductive metal and a receptacle 10 made of synthetic resin and to be fit externally to the housing 70 with each busbar 100 mounted therein. When the receptacle 10 is fit externally to the housing 70, the respective terminal fittings 90 are short-circuited to the corresponding busbars 100 in a predetermined short circuit pattern. Note that left and right sides of FIG. 1 are referred to as front and rear ends concerning a front-back direction.

The terminal fitting 90 is long and narrow in the front-back direction and includes a tubular connecting portion 91 and an open barrel 92 arranged behind the connecting portion 91. The barrel 92 is connected electrically and mechanically to an end part of a wire 80. A later-described tab 110 of the busbar 100 is inserted into the connecting portion 91 to be electrically connected.

The housing 70 is in the form of a flat block short in a vertical direction (first direction) and wide in a lateral direction (second direction) when viewed from the front and internally includes a plurality of cavities 71 into which the terminal fittings 90 are insertable. The cavities 71 are arranged in upper and lower stages and forwardly projecting locking lances 72 are provided on a partition wall between the upper and lower cavities 71. The locking lances 72 lock the connecting portions 91 to hold the terminal fittings 90 in the cavities 71.

Figure 5:
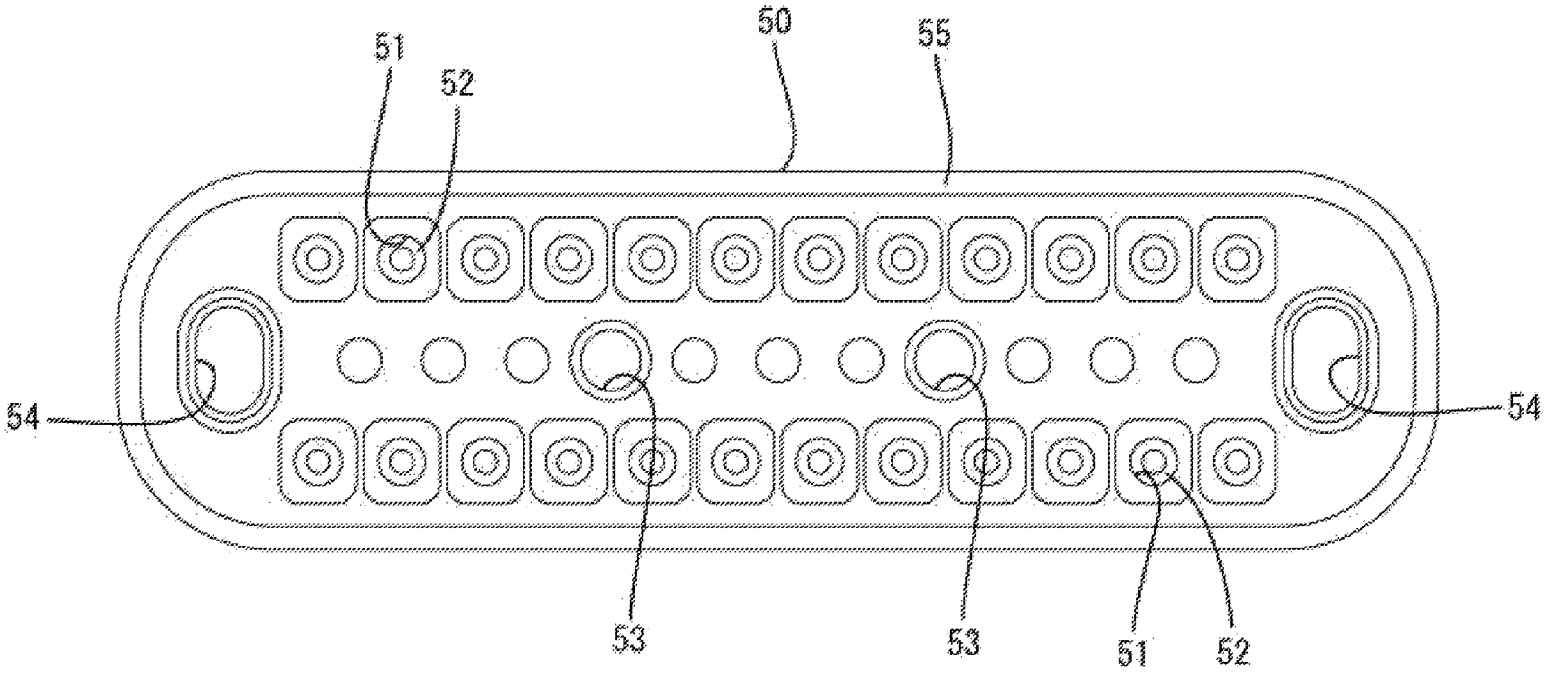
FIG. 5 is a front view of a one-piece rubber plug.

As shown in FIG. 5, the one-piece rubber plug 50 is flat mat wide in the lateral direction to correspond to the housing 70 and internally includes seal holes 51 through which the wires 80 connected to the terminal fittings 90 are insertable. The seal holes 51 are circular openings and are arranged in upper and lower stages to correspond to the respective cavities 71. Inner peripheral lips 52 are provided circumferentially on the inner periphery of the seal hole 51 and can closely contact the outer peripheral surface of the wire 80.

Bottomed positioning holes 53 are provided side by side in the lateral direction between the upper and lower seal holes 51 on the front and rear surfaces of the one-piece rubber plug 50. Positioning pins 47 on the housing 70 and the rear holder 30 are fit into the respective positioning holes 53 to position the one-piece rubber plug 50 with respect to the housing 70 and the rear holder 30. Through holes 54 are provided on opposite left and right end parts of the one-piece rubber plug 50 across an area where the seal holes 51 are arranged. The through holes 54 have an elliptical opening slightly longer in the vertical direction.

Lips 55 are provided one after another on the outer periphery of the one-piece rubber plug 50. Each lip 50 is provided over the entire circumference of the one-piece rubber plug 50 while having a constant projecting dimension. When the receptacle 10 is fit externally to the housing 70, each lip 55 is held in close contact with an open rear end part of the receptacle 10 and a clearance between the receptacle 10 and the one-piece rubber plug 50 is sealed in a liquid-tight manner.

Figure 2:
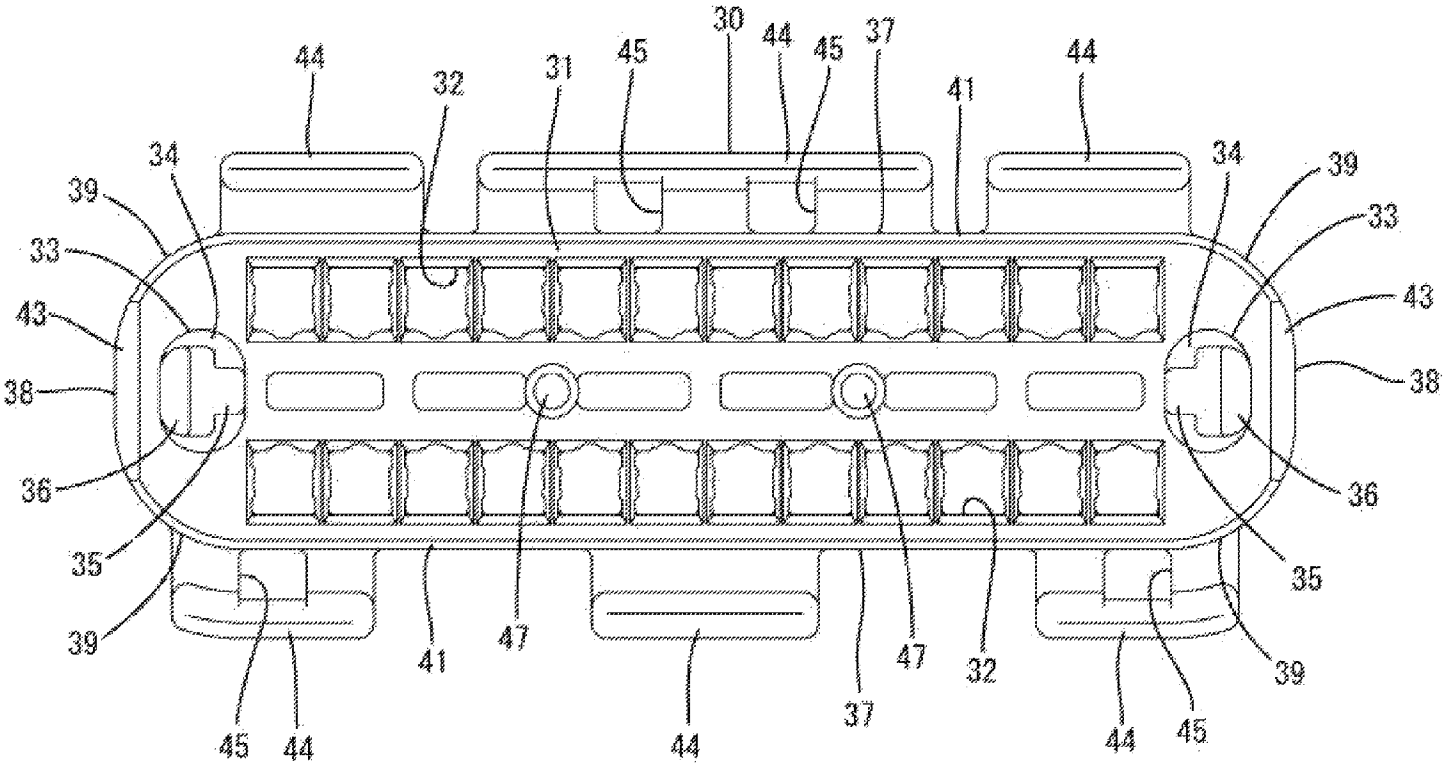
FIG. 2 is a front view of a rear holder.

As shown in FIG. 2, the rear holder 30 includes a holder main body 31 defining a flat plate short in the vertical direction and long in the lateral direction when viewed from the front and corresponding to the housing 70. Wire insertion holes 32 penetrate through the holder main body 31 in the front-back direction through and the wires 80 can be inserted loosely therethrough after insertion of the terminal fittings 90. The wire insertion holes 32 have substantially rectangular cross-sectional shapes corresponding to that of the connecting portions 91 of the terminal fittings 90 and are arranged in upper and lower stages to correspond to the respective cavities 71 and the seal holes 51.

Figure 3:
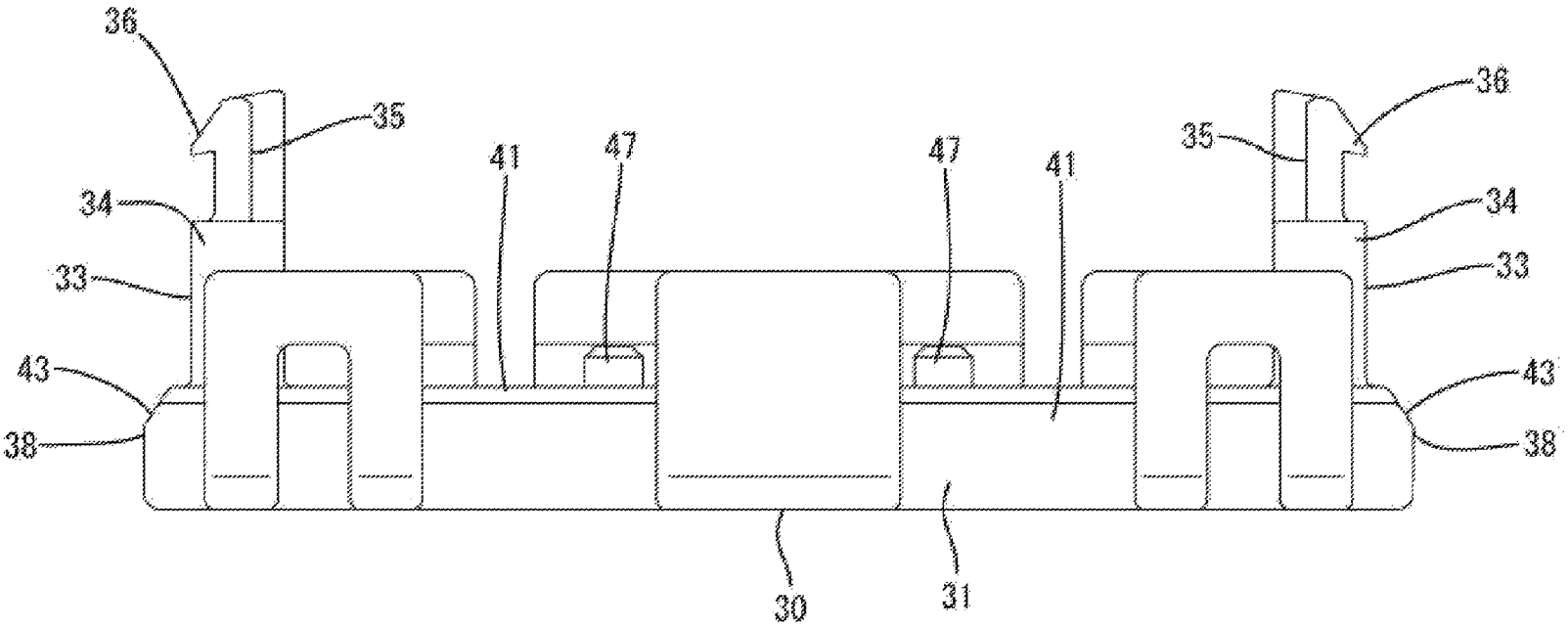
FIG. 3 is a bottom view of the rear holder.
Figure 7:
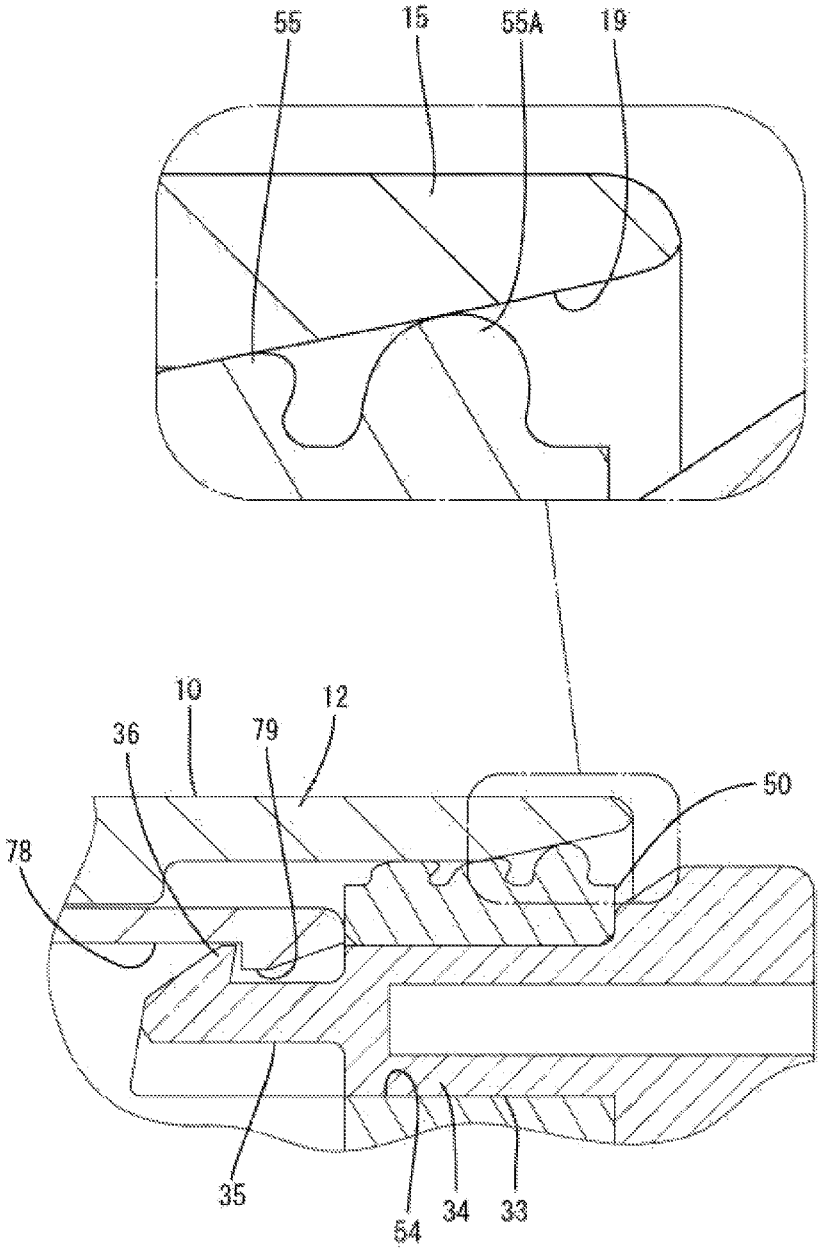
FIG. 7 is an enlarged view of an essential part while the receptacle is being externally fitted to a housing.

The positioning pins 47 project side by side in the lateral direction on the front surface of the holder main body 31 and are insertable into the positioning holes 53 on the rear surface of the one-piece rubber plug 50. Lock pieces 33 project forward on opposite left and right ends of the front surface of the holder main body 31 across an area where the respective wire insertion holes 32 are arranged. As shown in FIG. 3, each lock piece 33 has a column-like base 34 and a lock main body 35 projecting forward from the tip of the base 34. The base 34 has an elliptical cross-sectional shape corresponding to the through hole 54 of the one-piece rubber plug 50. The lock main body 35 is slightly smaller than the base 34. The base 34 is held in close contact with the inner periphery of the through hole 54 and penetrates through the one-piece rubber plug 50 in a liquid-tight manner. The lock main body 35 is deflectable and deformable with a coupled part to the base 34 as a support. A claw-like locking projection 36 projects out on a tip part of the lock main body 35. As shown in FIG. 7, the lock main body 35 is inserted into a locking hole 78 open on the rear surface of the housing 70 and the locking projection 36 is locked resiliently to a lock receiving portion 79 formed on the inner surface of the locking hole 78 to retain the rear holder 30 on the housing 70.

As shown in FIG. 2, both vertical end parts of the holder main body 31 include long surfaces 37 extending straight in the lateral direction when viewed from the front and both left and right ends of the holder main body 31 include short surfaces 38 extending straight in the vertical direction when viewed from the front. The holder main body 31 has four corner surfaces 39 connecting both left and right ends of the long surfaces 37 and both upper and lower ends of the short surfaces 38. The corner surfaces 39 are arcuate when viewed from front. A holder-side chamfer 41 is provided on the front end edge of each of the long surfaces 37 and the corner surfaces 39. As shown in FIG. 1, the holder-side chamfer 41 is tapered at a fixed angle toward the front.

Figure 8:
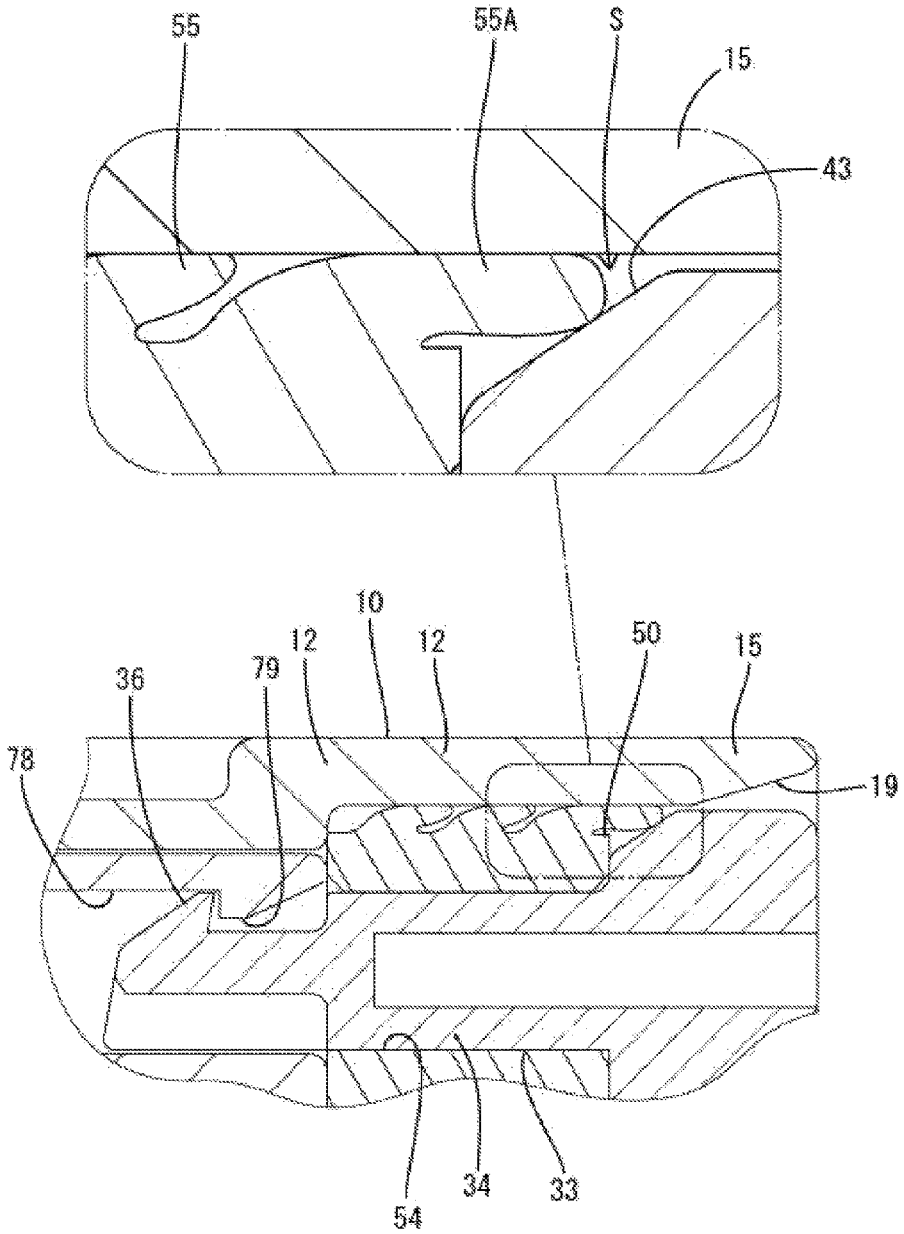
FIG. 8 is an enlarged view of an essential part in a state where the receptacle is externally fitted to the housing.

A holder-side escaping portion 43 in the form of a cut is provided on the front end edge of the short surface 38 of the holder main body 31. As shown in FIG. 8, the holder-side escaping portion 43 is tapered at a fixed angle toward the front. As shown in FIG. 3, angles of inclination of the holder-side escaping portions 43 and the holder-side chamfered portions 41 to the front-back direction are substantially equal. The holder-side escaping portions 43 have a longer length in the front-back direction than the holder-side chamfers 41, and the rear end edges of the holder-side escaping portions 43 are located behind those of the holder-side chamfers 41. Upper and lower ends of the holder-side escaping portion 43 are included in the corner surfaces 39 and arranged to be connected to the holder-side chamfered portions 41.

Figure 4:
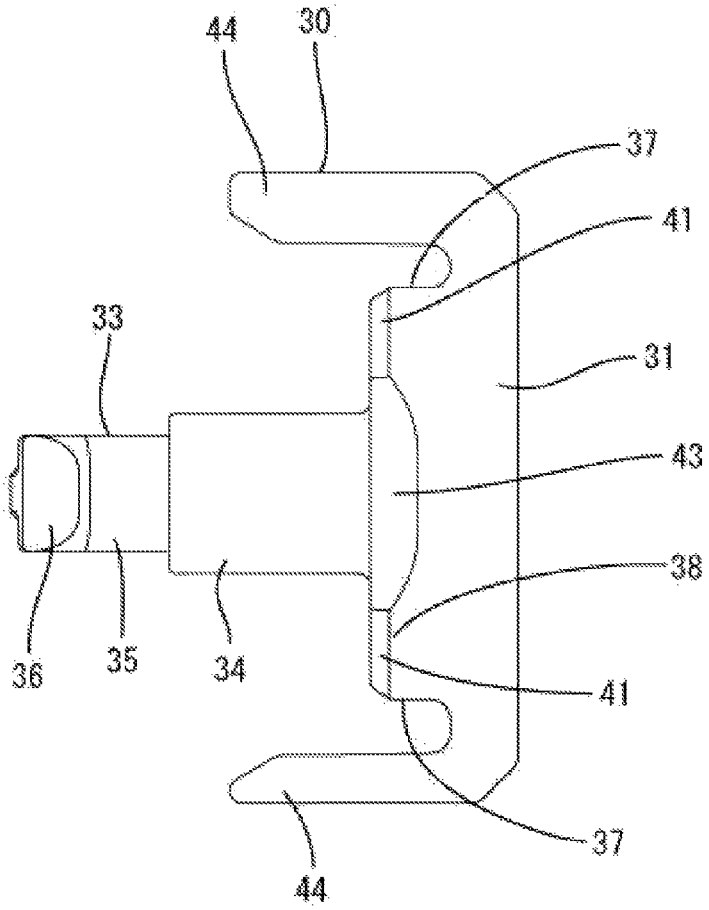
FIG. 4 is a side view of the rear holder.

As shown in FIG. 2, the front end edge of the holder-side escaping portion 43 extends straight in the vertical direction on the front surface of the holder main body 31. Further, as shown in FIG. 4, a vertical central part of the rear end edge of the holder-side escaping portion 43 extends straight in the vertical direction and both upper and lower end parts thereof arcuately extend from the vertical central part toward the holder-side chamfered portions 41.

Holding pieces 44 project side by side in the lateral direction on the upper and lower long surfaces 37 of the holder main body 31. Each holding piece 44 is arranged above the holder-side chamfer 41 and is in the form of a plate projecting forward after standing up. The holding pieces 44 located on both left and right sides of the lower long surface 37 and the one located on a lateral center of the upper long surface 37 have vertically penetrating holding holes 45, as shown in FIG. 1.

Figure 6:
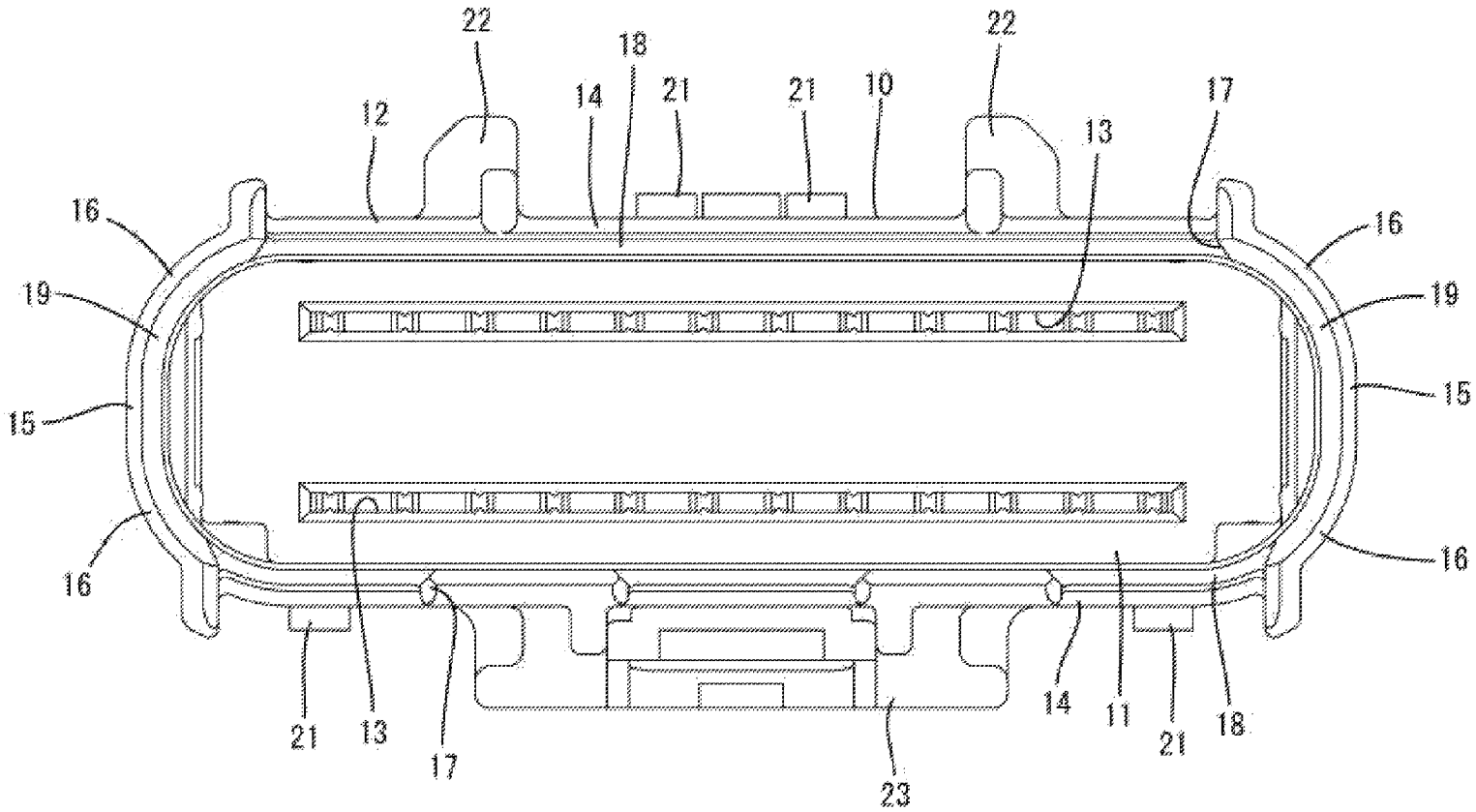
FIG. 6 is a rear view of a receptacle.

The receptacle 10 is a wide flat tube conforming to the shape of the housing 70. As shown in FIGS. 1 and 6, the receptacle 10 has a back wall 11 and a peripheral wall 12 projecting from the outer periphery of the back wall 11. Press-fit holes 13 are provided in upper and lower stages on the back wall 11 and the busbars 100 are press-fit therein. The busbars 100 include the tabs 110 that project into the receptacle 10 and connect to the corresponding terminal fitting 90.

As shown in FIG. 6, the peripheral wall 12 includes long upper and lower walls 14 extending straight in the lateral direction when viewed from behind and left and right short side walls 15 extending vertically. Arcuate corner walls 16 connect left and right ends of the long upper and lower walls 14 to upper and lower ends of the short left and right side walls 15. Cuts 17 are provided on the rear end edges of the long upper and lower walls 14 and are recessed forward from the rear end edges of the left and right short side walls 15 and the corner walls 16. Standing-up parts of the holding pieces 44 are inserted into the cut portions 17 when the receptacle 10 is fit externally to the housing 70.

A receptacle-side chamfered portion 18 in the form of a cut is provided on the inner surface of a rear end part of the long side wall 14. The receptacle-side chamfers 18 has a tapered shape opening at a fixed angle toward the back. Further, a receptacle-side escaping portion 19 in the form of a cut is provided on the inner surfaces of rear end parts of the short side walls 15 and the corner walls 16. The receptacle-side escaping portion 19 has a tapered shape opening at a fixed angle toward the back. An angle of inclination of the receptacle-side escaping portions 19 to the front-back direction is smaller than that of the receptacle-side chamfers 18 to the front-back direction. The receptacle-side escaping portions 19 have a longer length in the front-back direction than the receptacle-side chamfers 18. The rear end edges of the receptacle-side escaping portions 19 are located behind those of the receptacle-side chamfers 18 (except the receptacle-side chamfers 18 on the side of the cut portions 17).

Claw-like holding projections 21 are provided at positions behind the receptacle-side chamfers 18 on the outer surfaces of the upper and lower long walls 14. As shown in FIG. 1, the receptacle 10 is fit externally on the housing 70 and the holding projections 21 are inserted resiliently into the holding holes 45 of the holding pieces 44 so that the receptacle 10 is held on the housing 70 via the rear holder 30. As shown in FIG. 6, two holding projections 21 are arranged in each of a lateral central part of the upper long wall 14 and on both left and right sides of the lower long wall 14. Rail-like guides 22 are provided at opposite left and right sides across the holding projections 21 on the outer surface of the upper long wall 14 and extend in the front-back direction. Further, a flat box-shaped mounting portion 23 is provided between the left and right holding projections 21 on the outer surface of the lower wall 14. The guides 22 and the mounting portion 23 are mounted by being engaged with an unillustrated bracket mounting structure.

The connector is assembled by initially mounting the one-piece rubber plug 50 on the housing 70 from behind. At this time, the one-piece rubber plug 50 is positioned with respect to the housing 70 by inserting unillustrated positioning pins of the housing 70 into the positioning holes 53 of the one-piece rubber plug 50. As a result, the seal holes 51 of the one-piece rubber plug 50 communicate with the respective cavities 71 of the housing 70.

The rear holder 30 then is mounted to the housing 70 from behind to cover the rear surface of the one-piece rubber plug 50. The lock main bodies 35 of the lock pieces 33 are inserted into the locking holes 78 of the housing 70 through the through holes 54 of the one-piece rubber plug 50 and the locking projections 36 of the lock main bodies 35 are locked to the lock receiving portions 79 to hold the rear holder 30 on the housing 70. At this time, the front surface of the holder main body 31 is in close contact with the rear surface of the one-piece rubber plug 50. Additionally, the positioning pins 47 of the rear holder 30 are inserted into the positioning holes 53 of the one-piece rubber plug 50. Thus, the one-piece rubber plug 50 is positioned with respect to the rear holder 30 and is sandwiched and held between the rear holder 30 and the housing 70. Further, the seal holes 51 of the one-piece rubber plug 50 communicate with the respective wire insertion holes 32 of the rear holder 30. Furthermore, the base ends 34 of the lock pieces 33 are inserted into the through holes 54 and the left and right ends of the one-piece rubber plug 50 are pressed against the base ends 34 and deform to bulge outward. In this way, the interior of the connector is held in a liquid-tight manner.

Subsequently, the terminal fittings 90 are inserted into the cavities 71 of the housing 70. The terminal fitting 90 is inserted into the cavity 71 from the wire insertion hole 32 by way of the seal hole 51. When the terminal fitting 90 is inserted into the cavity 71, the outer peripheral surface of the wire 80 is held resiliently in close contact with the inner peripheral lips 52 of the seal hole 51 and the one-piece rubber plug 50 is deformed to bulge slightly outward.

Subsequently, the receptacle 10 then is fit externally to the housing 70 from the front. In the process of externally fitting the receptacle 10, the inner surface of the rear end of the receptacle 10 slides on the lips 55 of the one-piece rubber plug 50 and the lips 55 are dragged by the receptacle 10 to tilt backward. At this time, on the long sides, the lips 55 slide on the receptacle-side chamfers 18 of the long side walls 14 and the long side walls 14 can resiliently bulge out utilizing their lateral lengths. Thus, sliding resistance between the lips 55 and the long side walls 14 is reduced and the tilt (inclination) of the lips 55 is also suppressed to be small. Further, on the short sides, the lips 55 slide on the receptacle-side escaping portions 19 of the short side walls 15, as shown in FIG. 7, but the receptacle-side escaping portions 19 are retracted out in directions away from the lips 55. Thus, as on the long sides, sliding resistance between the lips 55 and the short side walls 15 is reduced and the tilt of the lips 55 also is suppressed to be small. Therefore, the lips 55 do not tilt back large amounts in the process of externally fitting the receptacle 10.

When the receptacle 10 is fit externally to the housing 70, the receptacle-side escaping portions 19 and the receptacle-side chamfers 18 pass over the one-piece rubber plug 50 to be separated therefrom, the long surface portions 37 of the rear holder 30 are arranged to face the inner sides of the rear parts of the long side walls 14 and the short surfaces 38 of the rear holder 30 are arranged to face the inner sides of the rear parts of the short side walls 15. In this state, the respective holding projections 21 of the receptacle 10 are inserted and locked to the holding holes 45 of the respective holding pieces 44 of the rear holder 30 and the receptacle 10 is retained and held on the housing 70 via the rear holder 30.

As described above, the backward tilt of the lips 55 is suppressed by the deflection of the long side walls 14 and escaping structures of the receptacle-side escaping portions 19. Nevertheless, the lips 55 are dragged by the rear end part of the receptacle 10 to tilt back. However, the holder-side escaping portions 43 of the rear holder 30 are retracted behind the lips 55 on the short sides that tend to tilt large amounts and the holder-side chamfers 41 also are located behind the lips 55 on the long sides that are expected to tilt to a relatively small degree. Thus, the tilt of the lips 55 is permitted.

Specifically, as shown in FIG. 8, the last lip 55A is accommodated in a tilted state in a space S between the holder-side escaping portion 43 (also holder-side chamfer 41) of the rear holder 30 and the inner surface of the receptacle 10. Further, the last lip 55A is in contact along the tapered inclined surface of the holder-side escaping portion 43 and can be held in close contact with the inner surface of the rear end part of the receptacle 10 with a predetermined resilient force by receiving a reaction force from the rear holder 30. Thus, a clearance between the receptacle 10 and the one-piece rubber plug 50 is filled up with all the lips 55 including the last lip 55A and the sealability of the one-piece rubber plug 50 is ensured.

On the other hand, the last lip 55A is not pushed back strongly by the rear holder 30 due to the holder-side escaping portions 43 and the escaping structures of the holder-side chamfers 41. Thus, the last lip 55A is not likely to be caught between the inner surface of the receptacle 10 and the rear holder 30 and the damage of the lips 55 can be prevented.

As described above, the tilt of the lips 55 can be suppressed to be small in the process of externally fitting the receptacle 10 to the housing 70 since the receptacle-side escaping portions 19 are retracted in the directions to reduce the contact with the lips 55 on the short sides. Further, the tilt of the lips 55 on the long sides can be suppressed to be small by the deflection of the long side walls 14. Thus, the tilt of the lips 55 can be suppressed to be small on both short and long sides.

Further, when the receptacle 10 is fit externally to the housing 70, the tilt of the lips 55 is permitted by the holder-side escaping portions 43 and the holder-side chamfers 41 and the tilted lips 55 are not pushed back strongly by the rear holder 30. Thus, the lips 55 will not be caught between the receptacle 10 and the rear holder 30. As a result, the lips 55 will not be damaged and the satisfactory sealing of the one-piece rubber plug 50 is ensured.

Further, since the receptacle-side chamfers 18 need not have a large retracted shape unlike the receptacle-side escaping portions 19, the receptacle 10 need not be enlarged. Further, the holder-side escaping portions 43 are tapered and inclined back and the lips 55 can be inclined along the holder-side escaping portions 43. Thus, damage of the lips 55 can be prevented more reliably.

Furthermore, since the lock pieces 33 are arranged at the positions closer to the short surfaces 38 than to the long surfaces 37, a contact pressure between the receptacle 10 and the lips 55 may increase and the lips 55 on the short sides may easily tilt when the lock pieces 33 penetrate through the through holes 54 of the one-piece rubber plug 50 and the one-piece rubber plug 50 bulges out. However, the holder-side escaping portions 43 are provided on the short sides so that the lips 55 can escape toward the holder-side escaping portions 43.

Furthermore, the receptacle-side escaping portions 19 are arranged at positions distant from the lips 55 and parts of the rear end part of the receptacle 10 other than the receptacle-side escaping portions 19 are held in close contact with the lips 55 with the receptacle 10 externally fit to the housing 70. Thus, predetermined sealing can be reliably ensured by increasing a close contact force between the receptacle 10 and the lips 55.

Other embodiments are briefly described below.

Although the busbars are mounted in the receptacle in the above embodiment, male terminal fittings may be accommodated in the receptacle and further connected to end parts of wires in the present invention.

The receptacle may be a mere cap (see, for example, Japanese Unexamined Patent Publication No. 2006-127992) holding no busbars.

In the present invention, contrary to the above embodiment, the short side walls and the short surface portions may be arranged along the lateral direction and the long side walls and the long surface portions may be arranged along the vertical direction. In short, when a short side direction of the short side walls and the short surfaces is a first direction, a long side direction of the long side walls and the long surface portions has only to be a second direction intersecting with the first direction.

Although the short side walls and the short surface portions extend straight when viewed from front in the above embodiment, the short side walls and the short surface portions may be arcuately curved when viewed from front in the present invention.

The rear end part of the housing may be structured to include an accommodation recess for accommodating the one-piece rubber plug.

The receptacle may be structured to be held on the housing by being locked to the housing.

The holder-side escaping portions may be provided in ranges including the short surface portions and the corner surface portions.

The receptacle-side escaping portions may be provided only on the short surface portions.

LIST OF REFERENCE SIGNS

10 . . . receptacle
14 . . . long side wall
15 . . . short side wall
19 . . . receptacle-side escaping portion
30 . . . rear holder
37 . . . long surface
38 . . . short surface
43 . . . holder-side escaping portion
50 . . . one-piece rubber plug
55 . . . lip
70 . . . housing
80 . . . wire
90 . . . terminal fitting

What is claimed is:

1. A watertight connector, comprising:

a housing into which terminal fittings are to be inserted;

a one-piece rubber plug arranged on a rear end part of the housing, including seal holes through which wires connected to the terminal fittings are to be inserted in a liquid-tight manner and including a lip on an outer periphery;

a rear holder arranged behind the one-piece rubber plug and configured to sandwich the one-piece rubber plug between the housing and the rear holder by being locked to the housing; and a receptacle to be fit externally to a front of the housing and having an opening end part to be held in close contact with the lip of the one-piece rubber plug, wherein:

the receptacle includes short side walls facing each other and extending in a first direction and long side walls facing each other and extending in a second direction intersecting the first direction;

the rear holder includes short surfaces arranged at inner sides of opening end parts of the short side walls and long surfaces arranged at inner sides of opening end parts of the long side walls; and holder-side escaping portions retracted more backward than front ends of the long surfaces are provided on front ends of the short surfaces of the rear holder.

2. The watertight connector of claim 1, wherein receptacle-side escaping portions are provided on the short side walls of the receptacle and are tapered and inclined backward.

3. The watertight connector of claim 1, wherein the rear holder includes lock pieces projecting forward through through holes of the one-piece rubber plug and having tip parts to be locked to the housing, and the lock pieces are arranged at positions closer to the short surfaces than to the long surfaces.

* * * * *